US006917785B2

(12) United States Patent
Chadwick

(10) Patent No.: US 6,917,785 B2
(45) Date of Patent: Jul. 12, 2005

(54) ELECTROMAGNETIC FIELD COMMUNICATIONS SYSTEM FOR WIRELESS NETWORKS

(75) Inventor: George G. Chadwick, Menlo Park, CA (US)

(73) Assignee: Cocomo MB Communications, Inc., Tokyo (JP)

( * ) Notice: Subject to any disclaimer, the term of this patent is extended or adjusted under 35 U.S.C. 154(b) by 53 days.

(21) Appl. No.: 10/358,743

(22) Filed: Feb. 4, 2003

(65) Prior Publication Data

US 2003/0143945 A1 Jul. 31, 2003

Related U.S. Application Data

(63) Continuation of application No. 09/340,218, filed on Jun. 25, 1999.

(51) Int. Cl.[7] ..... H04H 7/00

(52) U.S. Cl. ..... 455/3.06; 455/3.01; 455/41.1; 455/93; 455/523

(58) Field of Search ..... 455/93, 523, 3.01, 455/3.06, 41.1, 41.2, 9, 402, 899, 66; 340/310.01, 310.06, 310.08; 343/904; 333/227; 379/55.1

(56) References Cited

U.S. PATENT DOCUMENTS

| | | | | |
|---|---|---|---|---|
| 4,428,078 A | * | 1/1984 | Kuo | 455/3.06 |
| 4,698,639 A | * | 10/1987 | Mead et al. | 343/756 |
| 4,847,561 A | | 7/1989 | Soohoo | |
| 5,230,085 A | * | 7/1993 | Loposer | 455/41.2 |
| 5,302,960 A | | 4/1994 | Boers | |
| 5,696,861 A | * | 12/1997 | Schimmeyer et al. | 385/75 |
| 6,057,756 A | * | 5/2000 | Engellenner | 340/505 |
| 6,081,728 A | * | 6/2000 | Stein et al. | 455/523 |
| 6,151,354 A | * | 11/2000 | Abbey | 375/211 |
| 6,160,405 A | * | 12/2000 | Needle et al. | 324/538 |

OTHER PUBLICATIONS

Home Wireless Networks Wins . . . , Jun. 7, 1999.

Cisco Selects Share Wave Technology for Wireless Home . . . , May 11, 1999.

Home Wireless Networks, Inc., Now Completes . . . , Jun. 8, 1999.

The Home of the Future Is Here Today, Jun. 10, 1998.

Schism Grows Between Wireless Home–Net Camps, Jun. 7, 1999.

Wireless Internet Access See Strong Growth, Jun. 1, 1999.

Sony Links Telecoms With Consumer Products, Jun. 18, 1999.

AOL Plans High–Speed Service, Jun. 14, 1999.

Wireless Industry Gears Up . . . , Jun. 14, 1999.

Wireless–standard Trouble Hits Home, Jun. 7, 1999.

Wireless Begins Its Move To The Home Front, May 26, 1999.

Study: Wireless Data Poised for Growth, May 25, 1999.

Broadband Wireless: The Big Hertz, May 21, 1999.

* cited by examiner

*Primary Examiner*—Lee Nguyen
*Assistant Examiner*—Lewis West
(74) *Attorney, Agent, or Firm*—Michael J. Hughes; Intellectual Property Law Offices

(57) ABSTRACT

An Electromagnetic Field Communications System for Wireless Networks for producing an electromagnetic field within a structure is disclosed. The electromagnetic field is produced by using common conductive elements already present within virtually all pre-existing residential commercial, industrial buildings. These conductors, which may include electrical ground shields, wiring, pipes, sprinkler conduits or structural members, are excited with a signal, and become the cavity which contains the electromagnetic field. In preferred embodiments of the invention, signals are generated using the High Frequency, Very High Frequency and lower UHF bands (3 to 30, 30 to 300 and up to 400 MHz). The invention may be used to create a local area network inside the field and within the structure. Devices that include receivers tuned to the electromagnetic field may then be connected and networked. The system may be operated without causing interference to other conventional radio devices outside the structure in the HF band.

10 Claims, 5 Drawing Sheets

ELECTROMAGNETIC FIELD COMMUNICATIONS SYSTEM FOR WIRELESS NETWORKS

CROSS-REFERENCE TO RELATED APPLICATION

The present invention is a continuation application of copending U.S. patent application Ser. No. 09/340,218, filed Jun. 25, 1999.

INTRODUCTION

The title of the invention is the Electromagnetic Communications System for Wireless Networks. The inventor is George G. Chadwick. Mr. Chadwick is a U.S. citizen, and resides at 424 Sand Hill Circle, Menlo Park, California, 94025.

FEDERALLY SPONSORED RESEARCH OR DEVELOPMENT

None.

FIELD OF THE INVENTION

The present invention includes methods and apparatus for providing a wireless communications system. More particularly, the preferred embodiments of the invention utilize the High Frequency, Very High Frequency and the lower end of the Ultra High Frequency (HF, VHF & UHF) bands to generate electromagnetic fields within a building or structure. Conductors within the building or structure are used as an exciter to create a localized quasi-static electromagnetic field that may be used to connect a wide variety of devices without wires and without suffering undue interference from external noise.

BACKGROUND OF THE INVENTION

Over the past two decades, the meteoric rise of the personal computer has transformed the world. A recent report in Forbes notes that over 100 million personal computers were sold in 1998 alone. In just the past few years, the ability to connect all of these millions of computers dispersed across the globe through the World Wide Web has sparked a huge increase in the amount of information that is conveyed and business that is conducted on-line. A recent study conducted by the University of Texas and published in Fortune indicates that the U.S. Internet industry collected $300 billion in revenues in 1998, nearly as much as the American automotive industry.

Many experts in the telecommunications business believe that a new and even more dramatic phase of this communications revolution is about to unfold. Although millions of additional personal computers will continue to be added to the Internet, many new electronic devices will soon be connected in extensive networks for the first time, In his 1998 book entitled *New Rules for the New Economy,* Kevin Kelly estimates that there are currently six billion "chips in objects," other than those in computers, which are currently in operation around the world. Televisions, household appliances and lighting components, heating and cooling systems, security alarms and office equipment are all capable of being controlled or monitored by signals transported through network connections. Even the most prosaic appliances that utilize simple, single-purpose chips can be monitored or controlled by network signals.

One of the most serious drawbacks of trying to connect many devices in a network using conventional hardware is the need for cables, interface equipment and connector terminals. This is especially true in situations where wires are exposed in interior living or working spaces because they have been added after interior construction has been completed. A profusion of wires draped from a desk and tangled on the floor is an eyesore, and in some instances, a safety hazard.

One recent improvement has been the introduction of a limited number of devices that include wireless transmitters and receivers. Many printers, laptop computers and personal digital assistants use infrared ports to exchange data with computer systems. These infrared units have very limited range, and generally require a line-of-sight to their targets.

A number of new companies are attempting to develop wireless network systems. A new venture called OpenSky has been formed by 3C and Aether Technologies Bluetooth™ is a cooperative effort of several telecommunications companies seeking to establish a standard for wireless connectivity in the 2.45 GHz band. Home RF™ is a proposed wireless system offered by Microsoft™, Home Wireless Networks™ also plans to offer wireless networking products.

When radio waves are employed to connect devices in the United States, the manufacturer of the radio devices must be sure to operate within specific frequency bands and power limits prescribed by the Federal Communications Commission (FCC). The FCC allocates and coordinates the utilization of the Radio Frequency (RF) bands to ensure that interference among many different users of the spectrum is minimized. Some of the frequencies allocated by the FCC are situated in "unlicensed" bands, meaning that the use of these frequencies does not require the formal grant of a license from the FCC. Part 15 of the Code of Federal Regulations contains regulations which permit unlicensed radio transmissions if the transmissions meet many guidelines pertaining to power levels, antenna size, distance and other factors.

These complex government regulations present a serious obstacle to the development of any type of new wireless network, A wireless network may not be operated in frequency bands that are already licensed to other users, and may not operate in an unlicensed band unless it meets the stringent requirements of Part 15.

The problem of providing a high-speed, easily expandable and flexible network for linking many diverse devices and appliances has presented a major challenge to engineers and technicians in the communications industry. The development of methods and apparatus that could easily connect many different devices simply, at a relatively low cost, without wires and without causing interference to other users of the radio spectrum would constitute a major technological advance in the telecommunications business, and would satisfy a long felt need within the electronics and computer industries.

SUMMARY OF THE INVENTION

The *Electromagnetic Field Communications System for Wireless Networks* provides methods and apparatus for wirelessly connecting radio frequency devices within a quasi-static electromagnetic field, The field is produced by feeding a radio frequency signal to a conductor within a structure. In a typical residential, commercial or industrial building, the conductor may be a wire or ground shield in the electrical service, a water pipe or a structural member. By introducing the radio frequency signal to conductors within a building, the building itself becomes the exciter for the system.

The HF band has not been exploited in the past for communications networks because of problems stemming from 1) the high atmospheric and man made noise and 2) the large size of antennas for this region of the spectrum. The present invention solves these problems, and allows the HF band to be used for intra communications within a building or residence.

A building or residence is large relative to the wavelengths in the HF through the lower UHF regions. The electromagnetic fields are thus practical to excite, thereby solving the problem of normally used "large antennas." The structure of the excited ground system (or plumbing or structure or sprinkler) forms a cage which shields against man-made and galactic noise. This structure contains the RF energy.

The electromagnetic field established by the exciter is not a propagating wave in the normal sense. The field is not characterized by scatter, and is not generally affected by non-metallic walls or personnel. The entire building is now active and serves as an ideal medium for wirelessly connecting devices in the volume.

Contrast the above set of circumstances with the normally used FCC's Part 15 frequencies of 2400–2483.5 MHz or 5725 to 5850 MHz, where hundreds of millions of dollars are being spent to develop infra-structure communications systems in buildings and residences. The corresponding wavelengths are less than five inches at the lowest of these frequencies. The structures are now so large that energy propagates in the normal radiation manner. These bands are characterized by scatter and multi-path, which result in dead spots. Furthermore, signals do not readily pass through walls, and are severely affected by the presence of personnel.

These problems are usually solved by distributing a number of antennas throughout the structure. The resulting RF environment is characterized by interference zones where two antennas having near equal amplitudes create signal voids or nulls. Coaxial cable must also be routed throughout the structure. The term "wireless" now becomes arguable, because while the final connect is wireless, the installed cable is not. The advantage gained by operating above 2400 MHz is the small size of the antenna, typically less than 2 inches. A high price is thus being paid for the convenience of this small antenna.

In a preferred embodiment of the invention, the radio frequency signal is generally confined to the High Frequency (HF) from 3–30 MHz, or Very High Frequency (VHF) from 30–300 MHz, and the lower end of the Ultra High Frequency (UHF) from 300–3000 MHz band. this selection election results in a wavelength of from 100 to 10 meters from the high frequency (HF) band, and from 10 meters to 1 meter for the very high frequency (VHF) band. In a preferred embodiment of the invention, the wavelength that is employed should be on the order of the dimension of the building or residence in which the electromagnetic field is created.

The electromagnetic field is a non-propagating, quasi-static domain of 10 electromagnetic energy which is generally confined within the structure in which it is generated. Unlike conventional radio, which employs propagating waves that cause energy to radiate and travel away from an antenna, the present invention establishes a spatial region or volume characterized by electromagnetic voltage fields with magnitudes that vary at the frequency of the input radio signal. The electromagnetic field does not generally cause interference with radio devices outside the structure.

The present invention may be used to create a high-speed local area network within a building or residence. A wide variety of devices, including computers, cellular phones, personal digital assistants, conventional telephones, televisions, radios, security alarms, office equipment, lighting components, heating and cooling systems and many other appliances may be connected without wires using the electromagnetic field produced by the invention. Any device having the capability to produce information or to be controlled can be wirelessly connected to the enterprise developed to process such information or to control such functions.

The communications industry has realized that connectivity in residences and commercial buildings is the key to their future business growth. Increasingly, since the beginning of 1998, major firms have committed to expanding this market as the key to their growth. Such firms as Intel™, Cisco Systems Microsoft™ and Sun Microsystems among many others, have announced plans to penetrate the residence and building intra-communications market place. The proposed invention provides a seamless broadband methodology for achieving this end.

An appreciation of other aims and objectives of the present invention and a more complete and comprehensive understanding of this invention may be achieved by studying the following description of preferred and alternative embodiments, and by referring to the accompanying drawings.

A BRIEF DESCRIPTION OF THE DRAWINGS

A DETAILED DESCRIPTION OF PREFERRED & ALTERNATIVE EMBODIMENTS

I. Electromagnetic Waves

When radio frequency energy is coupled to a cavity, an electromagnetic field is created within the cavity. This cavity may be formed of solid metallic surfaces or a grid of wires. The coupler or exciter establishes currents in the walls which in turn establish an internal electromagnetic field. This field distribution is invariant with the magnitude of the voltage component of the field, varying only at the carrier rate of the exciting frequency.

Figure 1:
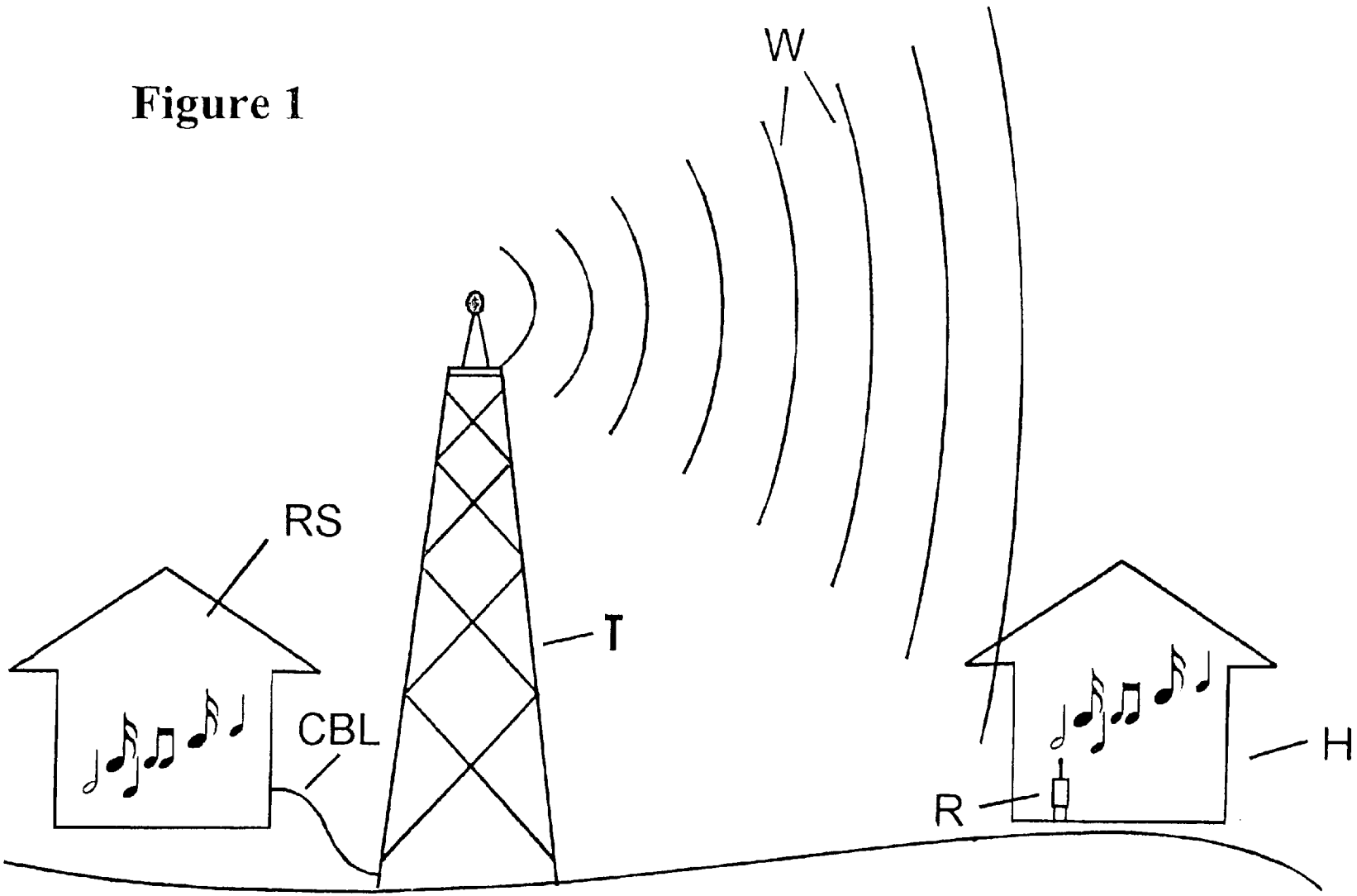
FIG. 1 is a schematic representation of a conventional radiating field, which causes radio waves to propagate and to travel away from an antenna.

FIG. 1 supplies a simplified schematic illustration of a conventional radio station RS. Radio signals containing the information that will be broadcast to listeners are fed to a tall metal transmitting tower T over a cable CBL. The tower is composed of conductive metal that creates a field of radio waves W. These fields propagate or travel great distances through the air, until they reach a radio receiver R like the one pictured in the house H in FIG. 1. The radio R detects and signal, and converts it to audible speech or music for a listener to enjoy.

The conventional radio waves that are utilized in FIG. 1 create a field that is called a "far-field," because the radio waves move out and away from the antenna tower and enable the operation of a radio receiver that is far away. The traveling waves move in accordance with a well understood electromagnetic theory of propagation, but in a layman's view, appear like ripples on the surface of a quiet pond that has been disturbed by a stone dropped in the water. Conventional radio equipment transmits electromagnetic energy to remote receivers using waves that can travel over great distances.

Figure 2:
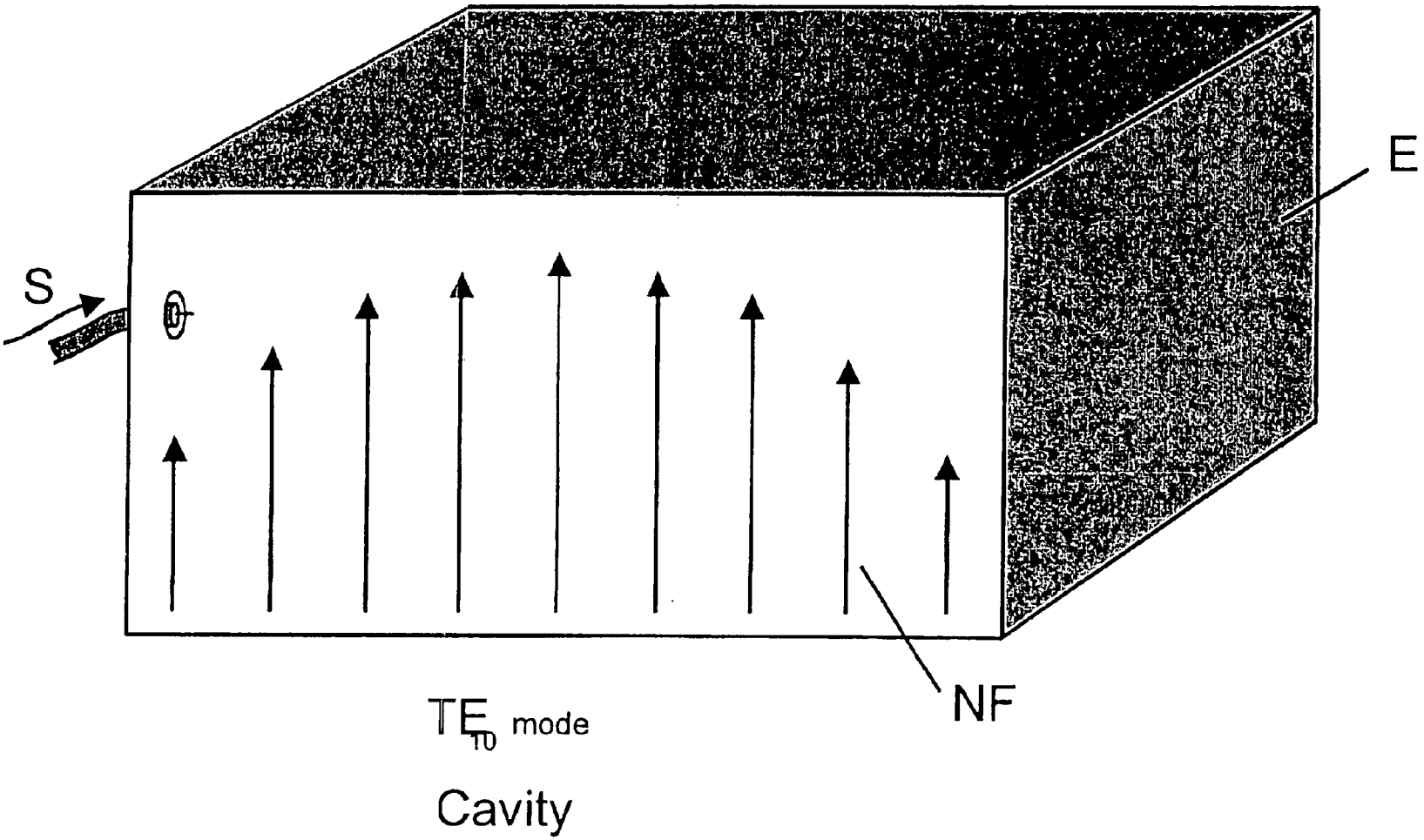
FIG. 2 is a schematic representation of a cavity-like electromagnetic field.

FIG. 2 offers an illustration of a very different kind of electromagnetic field. This field is electromagnetic. To produce such an electromagnetic field, a signal S is conveyed through a conductor connected to the rectangular metal enclosure E shown in FIG. 2. Inside the enclosure, the field which is generated is very different from the "far-field" depicted in FIG. 1. There are no propagating, traveling waves inside the metal box shown in FIG. 2. Inside, every point enclosed by the box is associated with an energy or voltage level. These point-by-point voltage levels vary according to the frequency of the input signal that energizes the box and the size of the box. The electromagnetic field may be called a "quasi-static" field, since it does not produce traveling waves for distant receivers.

A receiver placed inside the box illustrated in FIG. 2 can detect the signal S, but unlike conventional radio, the receiver would be "inside" a quasi-static non propagating wave. A more common technical term for a conductive enclosure which is energized to produce a confined electromagnetic field within its walls is a "cavity resonator."

II. A Preferred Embodiment of the Invention

The present invention utilizes the electromagnetic field phenomenon exhibited in FIG. 2 to create a region or "bubble" within an enclosure. The field is used to connect many different devices without wires, and even more importantly, without interference to other conventional radio devices. In one preferred embodiment of the invention, signals are generated in the High Frequency (HF) band, which spans the frequencies from 3 to 30 MHz. In an alternative embodiment of the invention, signals are generated in the Very High Frequency (VHF) band, which spans the frequencies from 30 to 300 MHz. Fields may also be generated in the lower end of the UHF band (at least up to 400 MHz).

The selection of these particular frequency ranges is important because the wavelengths associated with these frequencies are generally within an order of magnitude in size of the dimensions of the structures in which the field is created, This relationship is important, because if the structure becomes too large, it becomes an antenna for the creation of a far-field, and both scatter and multi-path begin to occur.

The high and very high frequency bands are especially useful for the implementation of the present invention because they are generally shunned by other users of conventional radio frequencies. This is true because signals propagated at these frequencies are plagued by many different types of natural atmospheric and man-made sources of noise.

Figure 3:
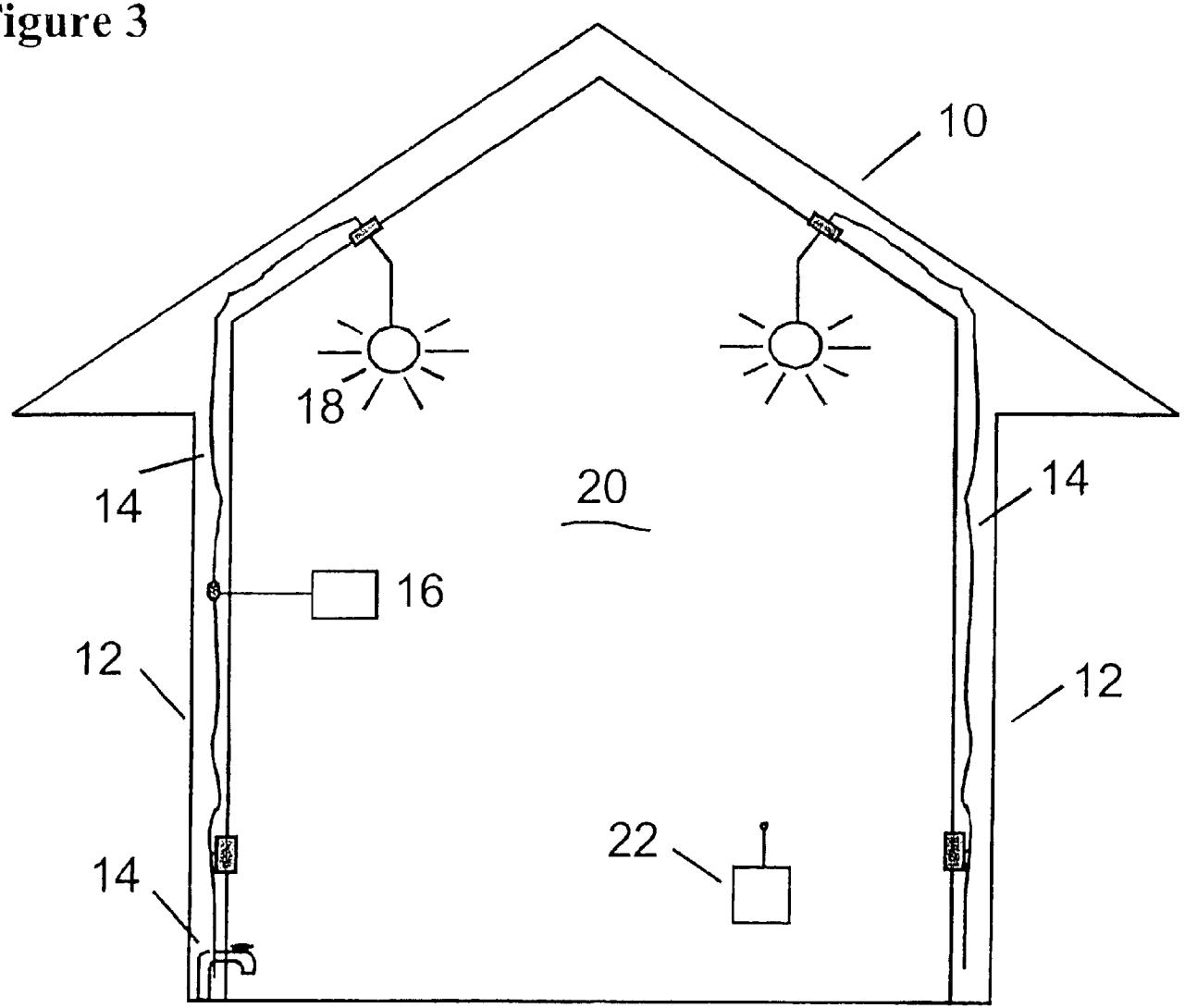
FIG. 3 is a pictorial, cut-away view of a typical house which includes conductors within its walls. A radio frequency signal generator is coupled to a conductor within the walls to establish an electromagnetic field within the house.

FIG. 3 portrays a structure or building 10 having walls 12 which include common metallic conductors 14 such as electrical ground shields, wires, sprinkler conduits, water pipes or structural members. These conductors 14 are activated or energized by introducing a signal from a signal generator 16 which is attached to one or more of the conductors 14 with a wire 18. In an alternative embodiment of the invention, the wire 18 may be omitted by energizing the conductors 14 with electromagnetic energy which is emitted from the signal generator 16.

The present invention uses the metal elements 14 already present in virtually all buildings and homes as a cavity antenna to create an electromagnetic field 20 within the building or home. A variety of devices 22 that include receivers are then able to be connected in a local area network without wires, This local area network may, in turn, be connected to public or private telephone lines, to a satellite transceiver, or to some other interface to the outside world.

Figure 4:
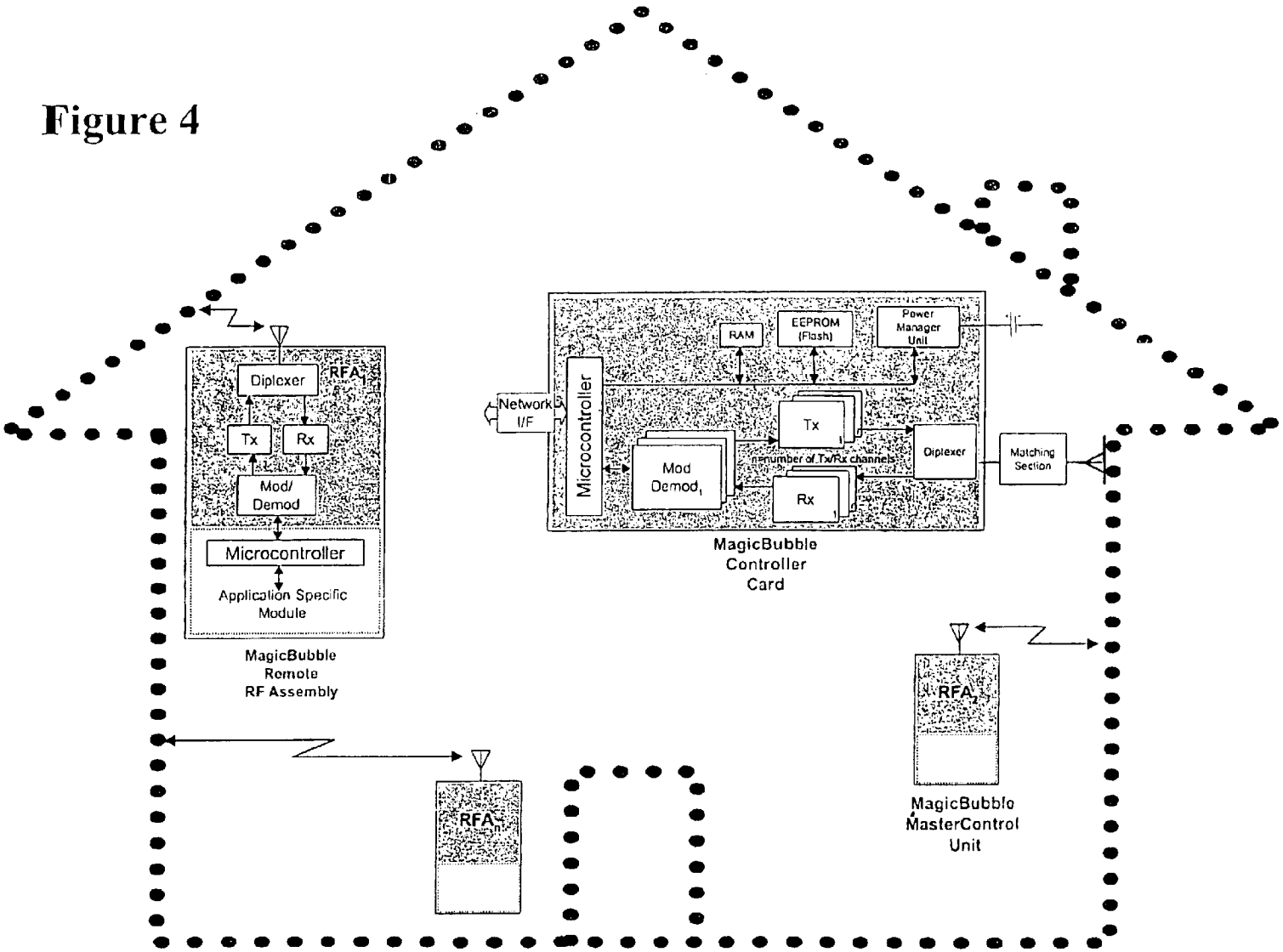
FIG. 4 is a circuit diagram of one embodiment of the invention.

FIG. 4 is a circuit diagram of one embodiment of the invention. The system has a controller which may be a card in a PC or a separate base station. This terminal is connected to the house ground system (or structure or plumbing, etc.) to excite the volume. Numerous devices then transmit within the volume, and are thus connected to the network. Their signals are received by the controller. The controller, which includes a router in one embodiment of the invention, separates the individual signals of different bandwidths and/or modulation formats, and routes them to their addressed target. The target may be the processor itself if devices are being monitored, or a remote device such as a video receiver which is receiving data from a VCR or TV. The target may also be a remote for which settings are being changed. For frequencies below 300 MHz, the transmitter, the receiver and all other hardware may be implemented digitally. In fact, a major advantage of the system is that the hardware for the frequencies in this invention is considerably cheaper than in the bands above 2400 MHz.

In one embodiment of the invention, the connection to the conductors in the volume is made through a matching section and then through a coaxial cable. The output of the coaxial cable is connected to the conductor, leaving the ground shield unterminated. When RF energy is connected to a terminal, part of the energy is transmitted as desired, and part is reflected. The reflection occurs because the impedance of the exciter is not the same as the generator, and, moreover, changes with frequency while the generator does not. The reflected energy represents a loss in efficiency and should be minimized. The matching section transforms the exciter impedance to achieve a minimum reflection over the band of operation. Generally, the exciter should be connected between 0.1 and 0.4 wavelengths above true ground to achieve a reasonable match. This restricts the bandwidth for a given attachment to 400%—more than adequate for the purposes intended.

Figure 5:
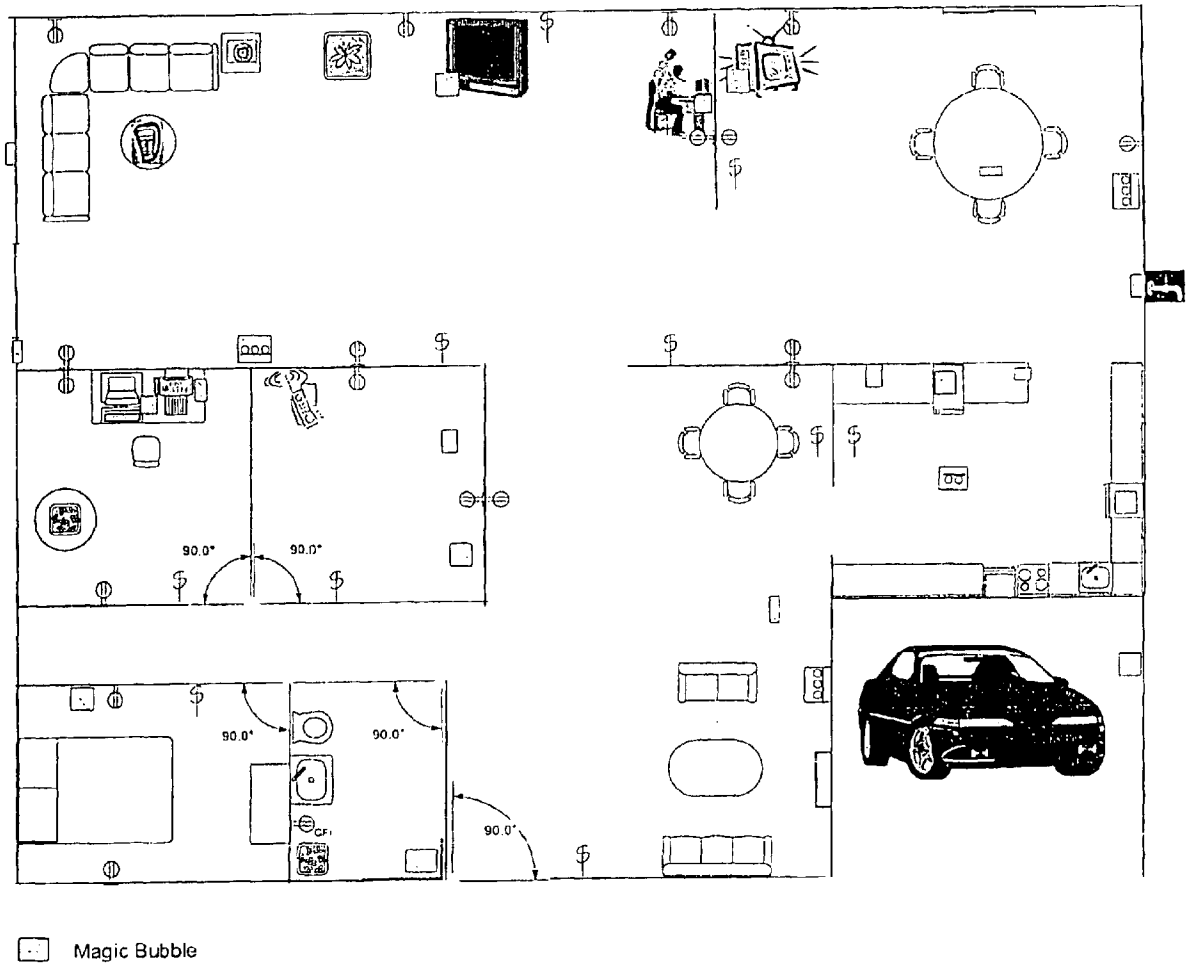
FIG. 5 is a pictorial representation of various devices in a typical house that may be connected wirelessly using the present invention.

FIG. 5 is a pictorial representation of various devices in a typical house that may be connected wirelessly using the present invention.

III. Wireless Operation Without Interference

The selection of the High Frequency, Very High Frequency, and the lower end of the Ultra High Frequency bands offers two important advantages to the implementation of the invention. First, since most other radio services avoid these bands due to atmospheric and man-made noise, these frequencies are generally available for a revolutionary new service such as that offered by the present invention. Secondly, these frequency bands require large antennas. At 30 MHz, an appropriate conventional antenna size is 50 feet, while a 150 foot conventional antenna would be preferable for 10 MHz. These dimensions are well-suited for this frequency band. For a building which is 50 by 100 feet and 20 feet tall, the building is 0.2×1.0×0.2 wavelengths at 30 MHz, or 0.1×0.5×0.4 wavelengths at 15 MHz.

When the electromagnetic field system is operated, the electrical conduits in the structure form a small set of grids, which are small relative to the HF wavelengths, and "cut off" radiation from outside sources, significantly reducing the effects of atmospheric and man-made noise. This grid acts as a screen which prevents energy from penetrating when the grid size drops below 0.5 wavelengths. The attenuation increases rapidly as the grid size (in wavelengths) reduces. A grid opening of 25 feet on a side is more than adequately small at 30 MHz and easily realized in any structure.

In the VHF and lower UHF bands, the grid protection slowly disappears as the size of the wavelengths become smaller. Fortunately, however, the man-made and galactic noise abate even more quickly. This latter interference usually drops below receiver noise at about 40 MHz. In these upper bands, noise shielding is not paramount, and the building excitation may continue to work as described above. However, as the frequency increases, energy begins to propagate outside the structure.

Experimental work has been performed from 3 to 30 MHz, 140 to 150 MHz and from 390 to 400 MHz. This experimentation has corroborated the above teachings. The experiments were used to transmit video and audio data in both a commercial building (100 feet by 200 feet) and a two story residence. It is quite possible to operate multiple HF, VHF and UHF bands in the same structure, as long as filtering is used.

Because of the unique properties of the electromagnetic field, many of the shortcomings that plague conventional radio communication such as scattering, dead spots and multi-path interference are avoided. Some higher frequencies are unable to pass through walls, and are severely effected by the presence of human bodies, Since HF and VHF waves are so large, these problems are generally avoided by the present invention.

IV. Terminology

In this Specification and in the Claims that follow, the term "conductor" is used to describe a type material that is characterized by an ability to convey or transport an electrical current. The use of the term is not, however, limited to typical conductors such as metal wires, cables or pipes. The conductor that is used to implement the invention may comprise any substance in which electrons or other charges are generally free to move to form a current and, consequently, generate a field.

Similarly, the term "structure" is not intended to be limited to any specific type 10 of building. When used in this Specification and in the Claims that follow, the term "structure" encompasses any complete or partial enclosure, or elements of a structure, including but not limited to a wall, partition, floor, window, ceiling or roof which form a cavity resonator.

CONCLUSION

Although the present invention has been described in detail with reference to a particular preferred embodiment, persons possessing ordinary skill in the art to which this invention pertains will appreciate that various modifications and enhancements may be made without departing from the spirit and scope of the Claims that follow. The methods and apparatus that have been disclosed above are intended to educate the reader about the preferred embodiments, and are not intended to constrain the limits of the invention or the scope of the Claims. Although the preferred embodiments have been described with particular emphasis on specific frequency bands, the present invention may be beneficially implemented using a variety of radio waves.

List of Reference Characters

FIG. 1

CBL Cable
H House
R Radio
RS Radio station
T Transmission tower
W Radio waves

FIG. 2

E Enclosure

FIG. 3

10 Structure or enclosure
12 Walls
14 Conductors
16 Signal generator
18 Connection from signal generator to conductor
20 Electromagnetic field
22 Device with receiver

What is claimed is:

1. A method comprising the steps of:

generating a radio frequency signal;

feeding said frequency signal to a conductor; said conductor being a conductive array existing within a structure;

creating a quasi-static non-propagating electromagnetic field within said structure, said electromagnetic field extending from said conductor in a manner such that said structure forms a cavity resonator; and using said electromagnetic field to convey said radio frequency signal to a receiver generally located within said structure.

2. A method as recited in claim 1, in which said radio frequency signal is generated using the High Frequency band.

3. A method as recited in claim 1, in which said radio frequency signal is generated using the Very High Frequency band.

4. A method as recited in claim 1, in which said radio frequency signal is generated using a frequency band which does not generally cause interference outside said structure in the HF band.

5. A method as recited in claim 1, in which said radio frequency signal is fed to said conductor using a direct, hard-wired connection.

6. A method as recited in claim 1, in which said radio frequency signal is fed to said conductor by exciting said conductor with transmitted radio frequency energy.

7. A method as recited in claim 1, in which said conductor is an electrical wire.

8. A method as recited in claim 1, in which said conductor is a water pipe.

9. A method as recited in claim 1, in which said conductor is a structural member.

10. A method as recited in claim 1, comprising the additional steps of:

installing said receiver by inserting a conventional power plug into a conventional electrical socket; and feeding said signal to said conductor through a third ground prong on said power plug.

* * * * *